United States Patent [19]

Van den Sype

[11] Patent Number: 5,064,479

[45] Date of Patent: Nov. 12, 1991

[54] THERMAL TREATMENT IN A FLUIDIZED BED

[75] Inventor: Jaak S. Van den Sype, Scarsdale, N.Y.

[73] Assignee: Union Carbide Industrial Gases Technology Corporation, Danbury, Conn.

[21] Appl. No.: 531,072

[22] Filed: May 31, 1990

[51] Int. Cl.[5] ..... C21D 1/53; F27B 15/02

[52] U.S. Cl. ..... 148/20.3; 148/16; 432/58; 432/15

[58] Field of Search ..... 148/20.3, 20.6, 13, 148/13.1, 16, 143; 266/172; 432/14, 15, 37, 58

[56] References Cited

U.S. PATENT DOCUMENTS 3,053,704 9/1962 Munday ..... 148/20.3
4,222,429 9/1980 Kemp ..... 164/34

FOREIGN PATENT DOCUMENTS 5917 1/1981 Japan ..... 216/259

OTHER PUBLICATIONS

Metals Handbook, 9th ed, vol. 4, pp. 299-306, 11/1981.

The "Bubbling Layer"-A New Quenching Medium with Controllable Cooling Capacity, N. N. Varygin, *Metal Science and Heat Treatment of Metals*, vol. 6, (1961), pp. 148-251.

"Fluid Bed Quenching of Steels: Applications are Widening", Delano and Van den Sype, *Heat Treating*, Dec. 1988.

"The Influence of a Substantial Fines Component on Bed-To-Tube Heat Transfer", Botterill and Hawkes, *Proceedings of the International Conference on Fluidization*, Alberta, Canada, May 7-12, 1989, pp. 661-668.

*Primary Examiner*—R. Dean
*Assistant Examiner*—Margery S. Phipps
*Attorney, Agent, or Firm*—Peter Kent

[57] ABSTRACT

Processes and apparatus for the thermal treating of articles, particulary for the quench hardening of metal alloys in an improved fluidized bed containing from 21 to 60 weight percent of fine alumina particles having a size from 20 to 100 microns and from 40 to 79 weight percent of coarse alumina particles having a size from 150 to 2000 microns.

25 Claims, 4 Drawing Sheets

FIG. 1
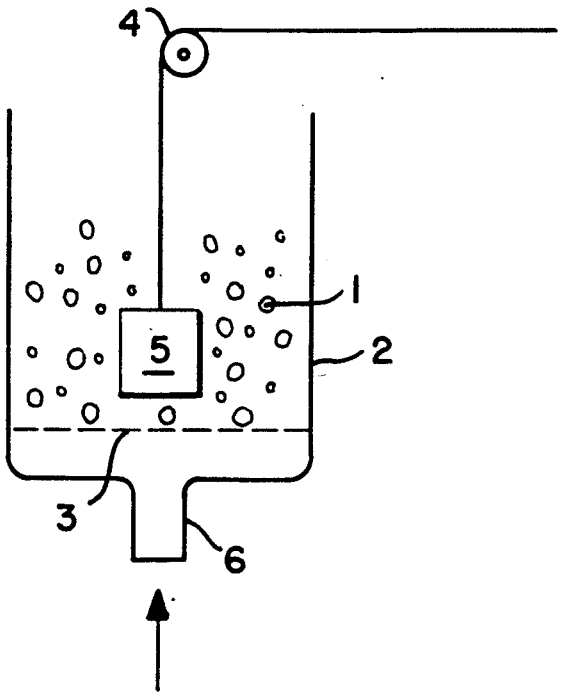
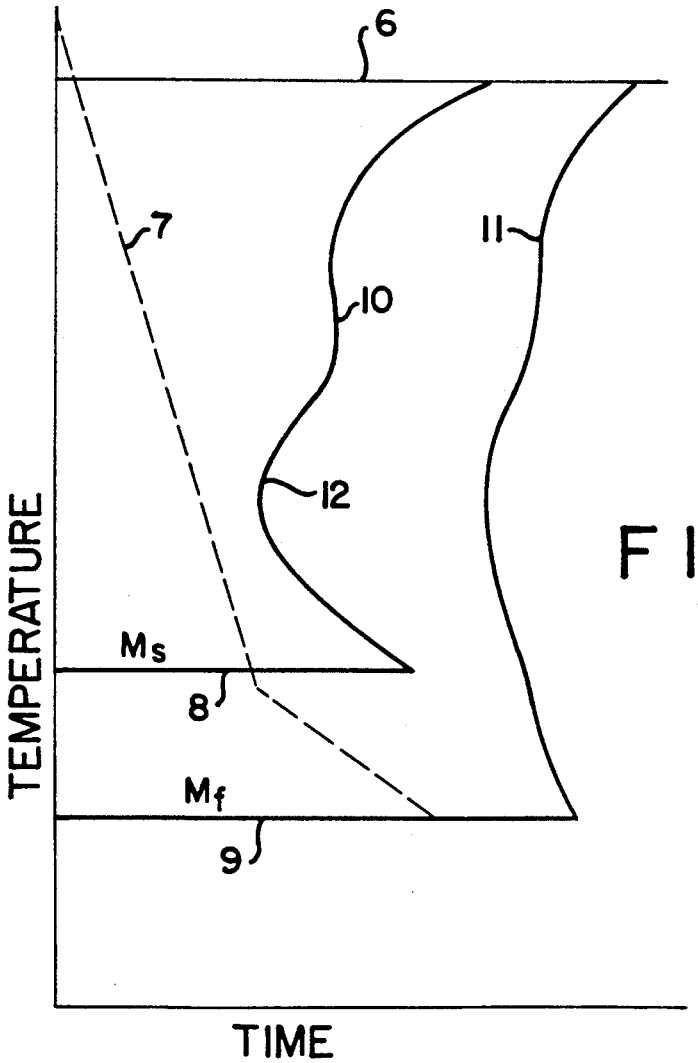
FIG. 2

THERMAL TREATMENT IN A FLUIDIZED BED

TECHNICAL FIELD

This invention pertains to the thermal treating of articles, and more specifically to the thermal treating of metal articles in an improved fluidized bed, and particularly to the quench hardening of carbon or alloy steel articles by immersion in the fluidized bed.

BACKGROUND ART

Thermal treatment of articles is frequently used in industry to alter or develop desired properties of the material comprising the article. Rapid heating or cooling of the article to a given temperature may be needed, or a slower, regulated rate of temperature change may be required. Also, holding an article at a given temperature for a period of time may be desired.

An important application of thermal treatment is the hardening of carbon and alloy steels. This is commonly accomplished by heating the steel article to a temperature of 1500 to 1700° F., where the alloy is transformed to the austenite phase, and then rapidly cooling or quenching the alloy. The composition of the alloy, the rate of cooling and the temperature levels attained determine the phases, and hence the properties of the final product.

Quenching may be accomplished in a number of ways. In spray quenching, the hot article is sprayed with a cool liquid. In gas quenching, the article is cooled by a flow of gas or vapor. A variation is fog quenching where a gas or vapor flow carries fine liquid particles into contact with the article. In immersion quenching, the article is immersed in a liquid bath such as water, oil, brine, polymer solution, liquid cryogen, or molten salt.

Each of these quenching methods, although successfully employed, have some undesirable characteristic. Liquid quenchants often leave a layer of deposit which must be removed. Polymers, and oils degrade with usage and age and must be replaced. Molten salts degrade with usage and present an environmental disposal problem. Most of the liquids boil and exhibit complex cooling behaviors (e.g. liquid phase convection, vapor phase convection, nucleate boiling) which are difficult to predict. In addition, the cooling behavior of each medium varies with the degree of agitation and the position and orientation of the article with respect to other articles in the medium. Further, the cooling performance may change due to thermal degradation, contamination or depletion of a component by drag out or distillation.

The use of fluidized beds for quenching obviates many of the problems associated with liquid quenchants. There is little or no cleaning of the article needed after quenching in a fluidized bed. The particles in a fluidized bed do not degrade rapidly with time or usage so that the cooling rates remain unaffected over long periods of time. The heat transfer mechanisms in a fluidized bed are dominated by the properties of the gas film on the article and the particles, and remain approximately constant throughout the quenching temperature range. Thus the quench rate of a fluidized bed is reproducible, can be adjusted within limits, and can be provided over a wide temperature range.

In spite of these advantages, fluidized beds have not found wide application for quenching because quench rates in fluidized beds approaching those obtainable in liquid baths have not been readily attainable in the past. The state of the art in fluidized bed quenching has been reviewed in an article entitled "Fluid Bed Quenching of Steels: Applications are Widening" published by M.A. Delano and J. Van den Sype in *Heat Treating*, December 1988. This article is hereby incorporated by reference, and some of its content is summarized following.

To employ a fluid bed to adequately harden an alloy steel article having a significant cross section (e.g., one-half to two inches thick) it is necessary to develop heat transfer coefficients similar to those obtainable in a well-agitated oil, namely 250 to 300 BTU/hr-ft$^2$-F°. This requires optimizing the fluid bed parameters of particle size, particle material, fluidizing gas composition, and fluidizing gas flow rate.

Fluidization of a mass of particles occurs when the particles are caused to separate from continuous contact with each other, move about and collide randomly with each other and confining boundaries. This can be accomplished, as is known, by vibrating the boundaries confining the bed, in particular, the bed support. Alternatively an article introduced into the bed for processing may itself be vibrated, thereby fluidizing the particles adjacent to the article. A method of fluidization that is more readily accomplished in commercial practice is passing a flow of fluid upward through the bed. The lowest flow at which the bed has expanded and the particles are suspended, move about and randomly collide is denoted the minimum fluidizing flow. Fluidization of particles by fluid flow of course can be combined with vibrofluidization, but a considerable increase in apparatus complexity is necessary. Thus fluidization by an upward flow of gas provides a means for exchanging heat between an article, the bed particles and the fluidizing gas, and is viable for thermal treating and quenching.

Particle diameters considered for use in fluidized bed quenching range from 20 to 2000 microns. Highest heat transfer coefficients in the bed are obtained as particle size is diminished to about 30 microns. When still smaller particles are fluidized by gas flow, the type of fluidization changes from a bubbly to an aerated character, and the heat transfer coefficient in the bed decreases Precipitously. To achieve high coefficients without risk of approaching the change in fluidization character and to maintain the loss of particles from the bed at an acceptable level, an operable lower Particle size is about 50 microns, and a preferred lower particle size is about 70 microns.

Particles that may be used in fluidized beds are metal oxide particulates such as aluminum oxide, chromium oxide, iron oxide and titanium oxide; refractory particulates such as silicon dioxide, mullite, magnesite, zirconium oxide and forsterite; and elemental particulates such as iron, copper, nickel and carbon. With the variety of materials and variations in porosity that can occur, the apparent density of the particles used in fluidization can be varied over a range of from 0.3 to 20 grams per cubic centimeter. Aluminum oxide in the form of alumina because of its inertness, high heat capacity and reasonable cost is a preferred bed constituent.

The thermal conductivity of the fluidizing gas has a major effect on the heat transfer coefficient in the bed—higher conductivities providing higher coefficients. Thus hydrogen and helium, which have thermal conductivities of 0.0975 and 0.0805 BTU/hr-ft$^2$-F°/ft, respectively, at room temperature, are high thermal conductivity gases while nitrogen and air, which have a thermal conductivity of about 0.014 Btu/hr-ft$^2$-F°/ft, are low thermal conductivity gases by comparison. Because of the flammability of hydrogen, helium is a preferred high thermal conductivity fluidizing gas. In some instances, lower heat transfer coefficients are acceptable so that less costly, low conductivity gases such as nitrogen or air are usable. Also mixtures of low and high thermal conductivity gases have utility. Gases, or mixtures of gases, with thermal conductivities equal to or exceeding 0.05 BTU/hr-ft$^2$-F°/ft at room temperature will be denoted high conductivity gases for convenience. Gases with lower conductivity will be denoted low conductivity gases.

The heat transfer coefficient in a fluidized bed increases with fluidizing gas flow rate from the minimum fluidizing flow until a maximum coefficient is reached over a range from five to fifteen times the minimum fluidizing flow. Beyond this range the coefficient gradually decreases due to the increased fraction of bubbles in the bed. Towards the high end of this flow range, particles are carried out of the bed in increasing amounts and the cost of the fluid used is a consideration. Thus preferred rates range from five to ten times the minimum fluidizing flow.

Pursuant to common Present practice, with a preferred combination of 70 micron diameter particles of alumina fluidized by helium at ten times the minimum fluidization rate, a heat transfer coefficient of 240 BTU/hr-ft$^2$-F° is developed. The quenching performance in this bed would be somewhat inferior to that of a well agitated oil bath where a coefficient of 280 is obtained. In addition, an undesirable amount of alumina material would be carried out of the bed by the fluidizing helium. Exposure of personnel to this effluent would be an unacceptable health hazard. The cost of the helium used would also be appreciable. To achieve a coefficient of 280 Btu/hr-ft$^2$-F° in the fluid bed, a flow of fifteen times the minimum fluidizing flow would be necessary. This would lead to still greater carry-out from the bed and still greater fluidizing gas cost.

While carry-out from the bed would be reduced by increasing the bed particle size, this is not a viable option. The heat transfer coefficient would decrease and the gas consumption would need to increase markedly.

Therefore an object of this invention is to achieve high heat transfer coefficients in a fluidized bed with reduced fluidizing gas flow rates and with reduced carry-out of bed particles.

Another object of this invention is to provide an apparatus and improved processes for quench hardening articles having thicknesses at least up to two inches.

Still another object of this invention is to provide a fluidized bed which will have greater utility in temperature treating materials.

Other objects and a fuller understanding of the invention may be had by referring to the following description and claims taken in conjunction with the accompanying drawings.

SUMMARY OF THE INVENTION

The objects of this invention are achieved in a fluidized bed comprised of particles of two distinct sizes, a coarse size and a fine size, wherein higher heat transfer coefficients are developed at lower fluidizing gas flow rates, and lower particle carry-out rates occur compared to existing art. For a range of fluidizing flow rates, the heat transfer coefficient in the two-particle-size bed is greater than in a bed consisting solely of the fine particle size. This is an unexpected result. Also, the carry-out of the fine particles is repressed by the coarser particles, which is another unexpected result.

With the novel bed, improved processes of wide latitude for the thermal treating of articles are possible. An article at an initial temperature may by immersion in the novel fluidized bed be heated or cooled to a desired temperature at a rate heretofore difficult to achieve in a fluidized bed.

The rate of heating or cooling may be tailored to fit a particular application and even varied during the processing. The available parameters are the particle material, the particle sizes, the fluidizing gas, the gas flow rate, and the bed temperature.

At a selected time or temperature, the bed may be defluidized thereby burying an immersed article in bed particles. The article may be retained in that insulating environment for a time to equilibriate to a uniform temperature, or to accomplish a desired transformation. Fluidizing gas flow may then be resumed and the thermal processing continued.

BRIEF DESCRIPTION OF THE DRAWINGS

FIG. 1 is a schematic representation, not to scale, of a fluidized bed apparatus embodying this invention.

FIG. 2 is a schematic time-temperature-transformation diagram for a representative steel alloy amenable to quench hardening.

DETAILED DESCRIPTION

Figure 3:
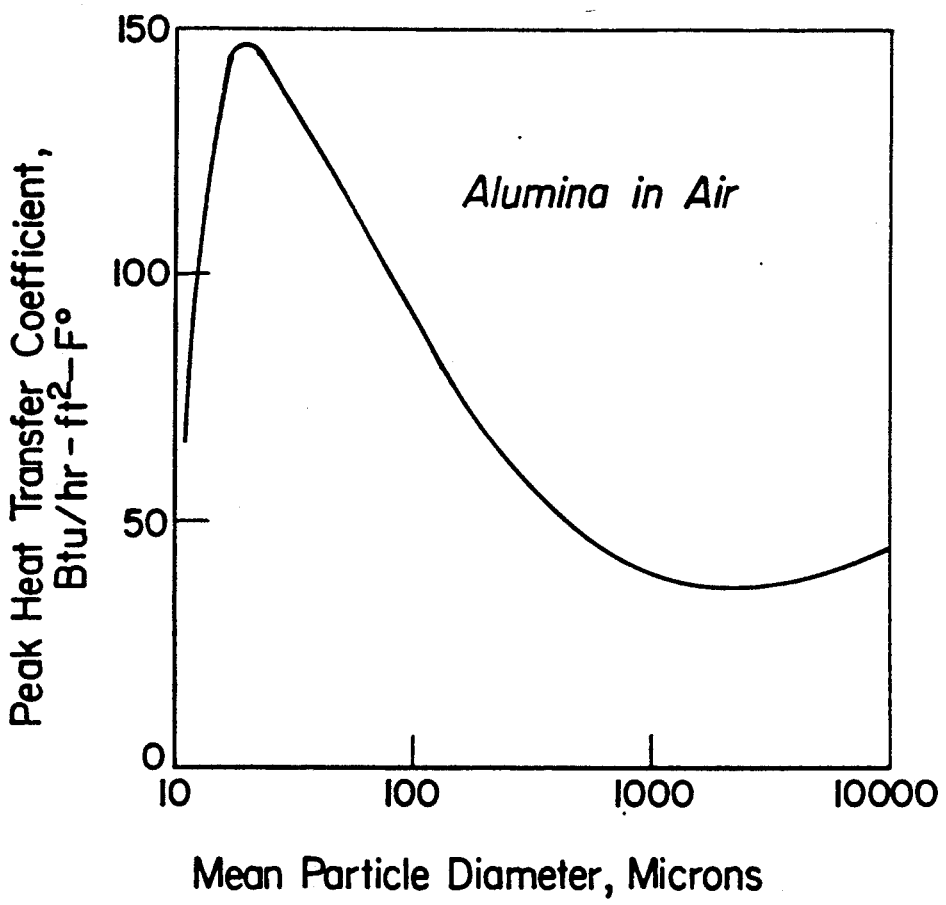
FIG. 3 is a plot of the peak heat transfer coefficient obtained as a function of fluidizing air flow rate in fluidized alumina beds of varying particle size.

The apparatus comprising this invention is shown schematically in and shall be described with reference to FIG. 1. The heat treating bed 1 is composed of particles of two distinct sizes—fine and coarse. The fine particles have a mean diameter selected from the range of 20 to 100 microns and the coarse particles have a mean diameter selected from the range of 150 to 2000 microns. Specification of a mean diameter recognizes that Particulate materials commercially available have a distribution of particle sizes and function satisfactorily in this invention. Operable mixtures for which the invention benefits are obtained using the preferred material alumina are from 10 to 60 weight percent of the fine size and from 40 to 90 weight percent of the coarse size. A preferred composition is 10 to 50 weight percent of alumina particles with a mean diameter in the range of 30 to 70 microns and 50 to 90 weight percent of alumina particles with a mean diameter within the range of 150 to 300 microns.

The bed is confined in a vessel 2 with lateral walls and a bed support plate 3 capable of retaining the bed particles and passing fluid. The vessel 2 is provided with means for immersion 4 of an article 5 for thermal treating. To employ the Preferred means for fluidizing the particles, the vessel has an inlet 6 for the introduction of a flow of fluid. Other fluidization means not shown but known in the art are mechanisms for vibrating the bed support plate 3 or vibrating the article 5 itself. A flow of fluid directed into the bed can be used in conjunction with vibrofluidization of the particles to assist in the fluidization of the particles or solely to provide a desired fluid atmosphere.

While the disclosed apparatus is useful in many applications, it is particularly useful for the thermal treating of steel alloy articles. Hence the invention will be described in detail as used in that application. However, other applications will be apparent to those skilled in the art upon reading this specification and examining the drawings.

Steel alloys which may be quench hardened by the use of this invention are chromium-molybdenum steels such as AISI type 4130 and 4140; nickel-chromium-molybdenum steels such as AISI 4340, 8620, 8630 and 9860; nickel-molybdenum steels such as AISI 4640; chromium steels such as AISI 5140; series 1100 steels such as AISI 1141 and 1144; and heat treatable ductile and malleable irons.

The quench hardening process is begun by heating the steel alloy article to an initial temperature of 1500° F. to 1700° F. so that the alloy substantially transforms into a phase or structure known as austenite. Next the hot article is quenched by immersing it in a fluidized bed of particles having the composition disclosed earlier.

The fluidizing flow can be from 1.5 to 15 times the minimum fluidizing flow. However, the preferred range is from 3 to 13 times the minimum fluidizing flow where highest heat transfer coefficients are developed in the bed.

For the initial stage of quench hardening alloy steels, high cooling rates in the bed are needed. Hence the gas used must have high thermal conductivity and helium is preferred. In the later stages of quench hardening alloy steels, a lower cooling rate is acceptable so that less costly, low thermal conductivity gases such as nitrogen or air may be used.

The processes which may be carried out with the disclosed fluidized bed are explained with reference to FIG. 2, which is a time-temperature-transformation diagram for a representative steel alloy. Diagrams for many alloys may be found in the *Atlas of Isothermal Transformation and Cooling Transformation Diagrams*, ASM, Metals Park, Ohio (1977). Definitions of alloy structure terms can be found in textbooks on heat treating or metallurgy such as *Heat Treaters Guide, Standard Practices and Procedures for Steel*, Unterweiser et al. ed., ASM, Metals Park, Ohio (1982) and *Metals Handbook*, Vol. 4 *Heat Treating*, ASM, Metals Park, Ohio (1981).

In FIG. 2, line 6 is a high temperature at which a steel alloy is substantially transformed into the austenite phase. Line 7 illustrates a cooling or quenching curve which shows the temperature of an article quenched according to this invention. Line 8 is the temperature ($M_s$) at which a usually desirable hard phase, martensite, starts to form in an alloy cooled from the austenitizing temperature 6. Line 9 is the temperature ($M_f$) at which the alloy is substantially transformed into martensite. Line 10 indicates the threshold where the cooling steel alloy will begin to transform into softer phases. Line 11 indicates where transformation into softer phases is completed.

As can be seen, threshold line 10 has a distinct lower leftward bulge commonly known as the nose 12. The time and temperature at which the nose 12 occurs will vary within the alloy, and for many alloys can be obtained from the atlas referred to above. As can be seen, to avoid the formation of softer phases in an article being cooled, the article must be cooled at a rate that its cooling curve 7 will reach the $M_s$ temperature 8 without intersecting the soft phase threshold 10. In particular it is seen that the initial cooling of an article from the austenitizing temperature 6 must be rapid enough that the cooling curve will miss the nose 12.

The requisite cooling rates are readily achieved by quenching in a fluidized bed composed and operated as disclosed herein. In addition, it should be apparent that to cool an article to the $M_s$ temperature, the bed operating temperature must be less than the $M_s$ temperature and preferably less than the $M_f$ temperature. The bed temperature may be regulated at any temperature or schedule of temperatures by supplying the fluidizing gas at an appropriate temperature to the bed. Heat can also be removed from or added to the bed with auxiliary heat transfer means such as coils within the bed. Regulate is used herein with the meaning of to fix or adjust the amount, degree, time or rate of change.

As is known to those skilled in the art, the fastest possible quench may not always be desirable because stresses and distortion may develop in the article. The quenching rate of the bed may be adjusted by: reducing the fluidizing gas flow, or changing to a gas of lower thermal conductivity, or raising the bed temperature. An appropriate point to make the change is when the article temperature has just dropped below the nose temperature. Quenching may then continue at a reduced rate to the $M_s$ temperature of the alloy substantially without forming softer phases in the article.

Another or alternate point at which a change in the cooling rate can be made is when the article has cooled to the $M_s$ temperature. Once the $M_s$ temperature is attained, the article may be removed from the bed for processing elsewhere. However, it is preferable to keep the article in the bed and further quench to the $M_f$ temperature. This further quenching, which is shown in FIG. 2 as the lower portion of cooling curve 7, can be carried out with the bed fluidized with high conductivity gas, or more economically with the bed fluidized with a low conductivity gas so long as the quench rate is sufficient to attain the $M_f$ temperature 9 without crossing softer phase threshold curve 11.

With the processing versatility that is available with the fluidized bed composition and operation as disclosed, specialized heat treating techniques, such as martempering, modified martempering, austempering and aluminum hardening can be readily carried out.

To practice martempering, the heated steel alloy article is immersed in the bed fluidized with high conductivity gas until the article temperature has dropped below the nose temperature, but is still above the $M_s$ temperature. The bed is then defluidized with the article still immersed until the article temperature equilibrates, i.e., until the temperature at the center of the article is substantially equal to the temperature at the article surfaces. Thereafter the bed is refluidized with low conductivity gas, and the article is quenched in the bed to the $M_f$ temperature.

In another martempering process, the heated steel alloy article is immersed in the bed fluidized with high conductivity gas until the article temperature has dropped below the nose temperature, but is still above the $M_s$ temperature. The bed is then fluidized with low conductivity gas and the article quenched in the bed to the $M_f$ temperature.

To practice a modified martempering process the heated steel alloy article is immersed in the bed fluidized with high conductivity gas until the article temperature has dropped below the $M_s$ temperature, but is still above the $M_f$ temperature. Thereafter the bed is fluidized with low conductivity gas and the article quenched in the bed to the $M_f$ temperature.

The rapid cooling capability of the disclosed bed may be used to austemper a steel alloy article to a final structure containing bainite, a softer phase. In austempering, the steel alloy article is initially raised to an austenitizing temperature and quenched by immersion into the disclosed fluidized bed held at a temperature slightly above the $M_s$ temperature, e.g., to the $M_s$ temperature plus 50° F. A high cooling rate is needed for the first portion of the quench during which the gas must be high conductivity gas. As the article temperature approaches or attains the fluidizing gas temperature, the fluidizing gas may, for economy, be changed to a low conductivity gas. The article is allowed to remain in the bed and soak at the fluidized bed temperature for a time sufficient to avoid the substantial formation of martensite in the alloy. Alternatively, the soaking may be conducted by defluidizing the bed and allowing the article to remain insulated by the quiescent bed particles. The soak may also be performed by alternating between the fluidized and defluidized conditions. Cast iron may be heat treated by a similar process.

The rapid cooling available in the disclosed bed can also be used to quench aluminum and aluminum alloy articles to achieve resistance to stress corrosion cracking and high strength after aging. Heretofore such articles have been quenched in water or polymer solution causing distortion of thin cross sections in the article. The cooling rate of the disclosed bed can be adjusted by manipulating the controlling variables previously described so that upon quenching an article in the bed, desired properties are achieved in the article without distortion.

The following example is submitted to illustrate but not to limit this invention.

EXAMPLE 1

To aid in the selection of bed particle size, the bed heat transfer coefficient was measured for a range of alumina Particle sizes and fluidizing air flow rates. The coefficient peaked as a function of the fluidizing flow rate, and the peak coefficient obtained for each size measured is shown in FIG. 3. Since high coefficients are desired, alumina with a mean particle size of 45 microns, which is close to the size that yields the maximum coefficient on the plot, was selected as the fine material in the dual particle-size bed. For the coarse material in the bed, alumina with a mean particle size of 280 microns was selected.

The distribution of particle sizes in the fine alumina is given in Table I.

TABLE I

| Sieve # | Particle Size Microns | Weight % |
|---|---|---|
| +200 | 74 | 6.2 |
| −200 +230 | 62 | 27.6 |
| −230 +325 | 44 | 22.2 |
| −325 | | 44.0 |

Mean particle size = 45 microns

The distribution of particle sizes in the coarse alumina is given in Table II.

TABLE II

| Sieve # | Particle Size Microns | Weight % |
|---|---|---|
| +25 | 710 | 0.3 |
| −25 +40 | 420 | 0.1 |
| −40 +60 | 250 | 59.2 |
| −60 +80 | 177 | 31.9 |
| −80 | | 8.5 |

Mean particle size = 280 microns

With helium as the fluidizing gas, heat transfer coefficients were determined for beds comprised of the fine alumina, the coarse alumina, and three mixtures thereof, namely 10, 20 and 36 percent fine alumina by weight. The coefficients were determined by measuring cooling rates obtained from quenching an instrumented nickel ball $\frac{7}{8}$ inches in diameter. The coefficients obtained are plotted in FIG. 4 and show surprising results. As summarized in Table III, to achieve a desirably high coefficient of 240 Btu/hr-ft$^2$-F°, fluidizing helium gas flows of 320, 170, 100, 70 and 158 scfh were necessary in beds composed of 0, 10, 20, 36 and 100 weight percent fine alumina respectively. Clearly the beds containing 20 and 36 percent fine alumina required less fluidizing gas flow and therefore were more economical to operate than the beds of 100 percent fine or 100 percent coarse alumina.

Figure 4:
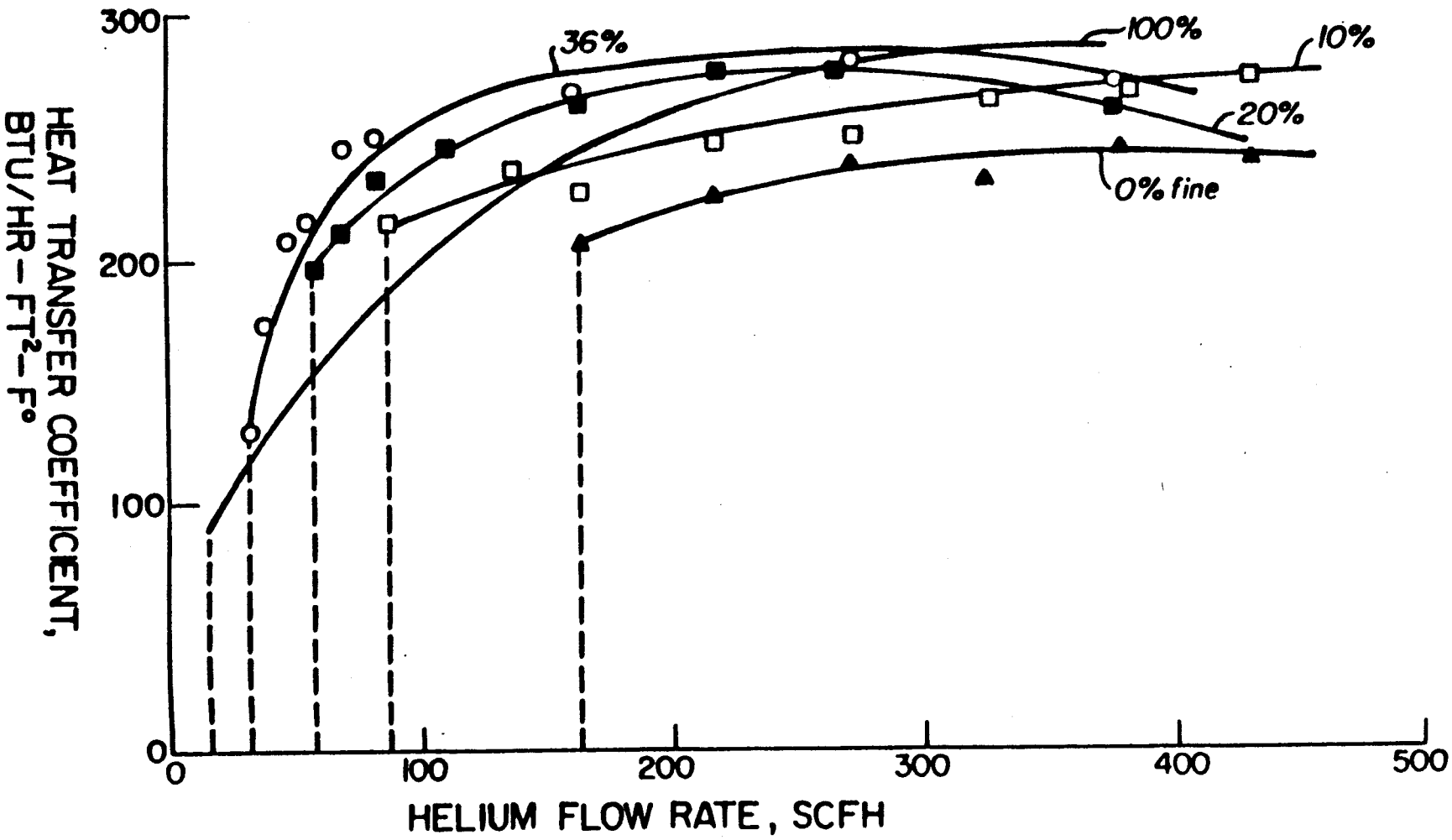
FIG. 4 is a plot of heat transfer coefficient as a function of fluidizing gas flow rate measured in fluidized beds comprised of varying proportions of fine and coarse alumina particles.

As also shown in FIG. 4, and summarized in Table III, comparing at a constant helium flow of 100 scfh (about 5 times the minimum fluidizing flow for a bed of 100 percent fine alumina), the coefficients were 200, 218, 238, and 255 in beds composed of 100, 10, 20 and 36 weight percent fine alumina respectively. At this gas flow, the bed composed of 100 percent coarse alumina (0 percent fine) was not yet fluidized. The beds containing 20 and 36 percent fine alumina yielded the highest coefficients.

TABLE III

| Bed Composition Weight percent Fine Alumina | He flow rate (scfh) to develop heat transfer coefficient of 240 Btu/hr-ft$^2$-F° | Heat transfer coefficient in Btu/hr-ft$^2$-F° at He flow rates of: 100 scfh | 164 scfh |
|---|---|---|---|
| 0 | 318 | Unfluidized | 207 |
| 10 | 170 | 218 | 238 |
| 20 | 105 | 238 | 263 |
| 36 | 77 | 255 | 274 |
| 100 | 158 | 200 | 242 |

Again as shown in Table III, comparing at a fluidizing flow of 164 scfh, (the minimum flow for fluidizing the 100 weight percent coarse bed), the coefficients were 207, 238, 242, 263 and 274 for beds composed of 0, 10, 100, 20 and 36 weight percent fine alumina respectively. Once again the beds with 20 percent and 36 percent displayed the highest coefficients.

Surprisingly, over a large range of fluidizing gas flows, beds composed of 20 percent and 36 percent fine alumina exhibited coefficients that were higher than the bed of 100 percent fine alumina. The bed with 36 percent fine reached a maximum coefficient of 282 at 260 scfh, whereas the bed with 100 percent fine reached a maximum coefficient of 288 at a much higher flow rate, 350 scfh.

EXAMPLE 2

A quantitative evaluation was made of the particles carried out of the bed by the fluidizing gas flows. Three feet over the top surface of the bed, a sample of air was drawn for ten minutes at a rate of 2 liters per minute through a filter which removed the solids. The weight gain of the filter was proportional to the solids loss rate from the bed. The data are shown in Table IV.

TABLE IV

| Bed Composition Weight % Fine Alumina | He gas flow scfh | Filter weight gain, grams | Heat transfer coefficient Btu/hr-ft$^2$-F° |
|---|---|---|---|
| 0 | 270 | 0.00026 | 235 |
| 20 | 80 | 0.00072 | 223 |
| 20 | 135 | 0.00091 | 255 |
| 36 | 135 | 0.00101 | 270 |
| 100 | 135 | 0.01198 | 225 |

It is seen that at a reasonable Operating flow rate of 135 scfh, the 100 percent fine alumina bed showed relatively high solids loss and a heat transfer coefficient of 226. At the same flow rate of 135 scfh, the 36 percent fine alumina bed had less than one-tenth the solids loss and a higher transfer coefficient of 270 Btu/hr-ft$^2$-F°. Clearly the bed composed of two particle sizes was advantageous in performance and economy.

Figure 5:
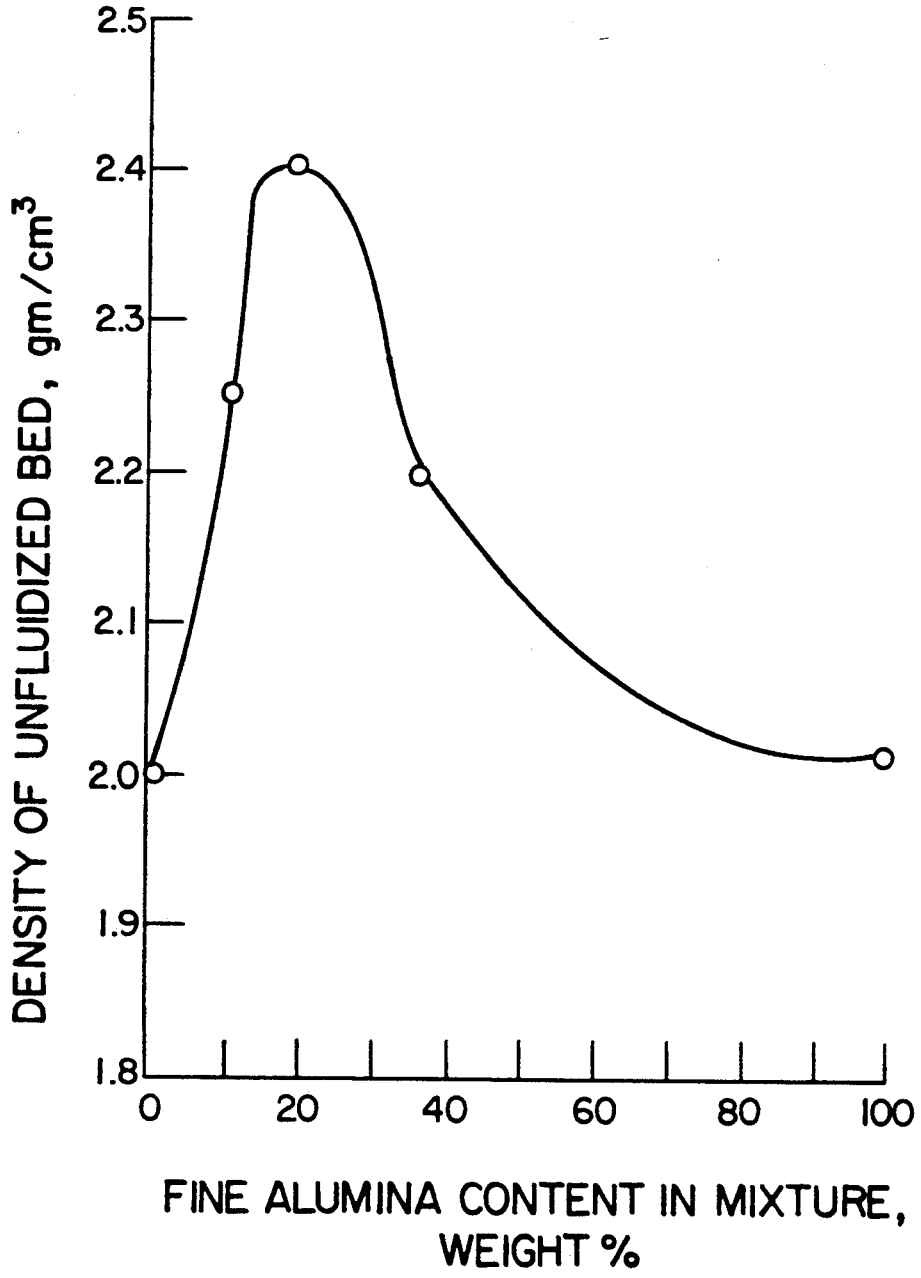
FIG. 5 is a graph of the apparent bulk density of beds of unfluidized alumina particles comprised of varying proportions of fine and coarse particles.

FIG. 5 shows the apparent bulk density of the unfluidized bed particles. The apparent densities of the aluminas with a single mean size—the fine and the coarse—are the lowest and about equal. This is expected since the apparent density of close packed spheres of uniform size is independent of their diameter. Upon mixing the fine and coarse aluminas, the apparent density increases substantially over the range of 10 to 40 weight percent of fine content. This is believed to occur because the fine particles fit into the interstitial spaces left by the coarse particles. For this to occur best, it can be shown from geometric considerations that the ratio of the fine particle diameter to the coarse particle diameter should not be greater than 0.414. Although not wishing to be held to any theory, applicants believe that this packing phenomenon is responsible for the observed heat transfer improvement in the bed and reduction of fine particle loss from the bed.

Having set forth the general nature and specific embodiments of the present invention, the scope is now particularly pointed out in the appended claims.

What is claimed is:

1. A process for thermally treating an article comprising:

providing the article at an initial temperature;

providing a bed with from about 21 to 60 weight percent of particles having a particle size within the range of from about 20 to 100 microns and about 40 to 79 weight percent of particles having a particle size within the range of from about 150 to about 2,000 microns;

at least partially immersing the article in the bed for a period of time;

fluidizing the particles adjacent to the article;

regulating the bed temperature; and withdrawing the thermally treated article from the bed.

2. The process of claim 1 wherein the particles have a density within the range of from 0.3 to 20 grams per cubic centimeter.

3. The process of claim 1 wherein the particles are alumina.

4. The process of claim 1 wherein the bed has from about 10 to 50 weight percent of particles having a particle size within the range of from about 30 to 70 microns and about 50 to 90 weight percent of particles having a particle size within the range of from about 150 to about 400 microns.

5. The process of claim 1 wherein fluidizing the particles is accomplished by vibrating the bed.

6. The process of claim 1 wherein fluidizing the particles is accomplished by vibrating the article.

7. The process of claim 1 wherein fluidizing the particles is accomplished by passing a flow of fluid upwards through the bed.

8. The process of claim 7 wherein the fluidizing fluid is a high conductivity gas for at least a portion of the period of time.

9. The process of claim 7 wherein the fluidizing fluid is a low conductivity gas for at least a portion of the period of time.

10. The process of claim 7 further comprising the step of reducing or ceasing the fluidizing fluid flow for at least a portion of the period of time with the article immersed in the bed.

11. The process of claim 8 wherein the high conductivity gas is helium.

12. The process of claim 9 wherein the low conductivity gas is nitrogen.

13. The process of claim 1 wherein the article is comprised of a steel alloy;

the initial temperature is an elevated temperature at which the alloy is substantially converted to austenite;

the bed temperature is regulated at a temperature below the $M_s$ temperature for the alloy; and the remaining bed variables are selected to cool the article at a sufficient rate that the alloy substantially will not begin to transform into phases softer than martensite.

14. The process of claim 13 wherein after the article has cooled to a temperature below the nose temperature, the cooling rate of the bed is reduced.

15. The process of claim 14 wherein the cooling rate is reduced by reducing or ceasing the fluidizing fluid flow rate.

16. The process of claim 14 wherein the cooling rate is reduced by changing to a fluidizing fluid of lower thermal conductivity.

17. The process of claim 1 wherein the article is comprised of a steel alloy;

the initial temperature is an elevated temperature at which the alloy is substantially converted to austenite;

the bed temperature is regulated at a temperature within the range of the $M_f$ temperature to the $M_s$ temperature plus 50° F.;

the article is immersed in the bed and allowed to cool to the bed temperature while the remaining bed variables are selected to cool the article at a sufficient rate that its cooling curve does not intersect the nose on the temperature-time-transformation diagram for the alloy; and thereafter adjusting the bed variables to maintain the article in the bed at the bed temperature for a time sufficient to avoid the substantial formation of martensite in the alloy.

18. The process of claim 17 wherein the article is maintained at the bed temperature by reducing or ceasing the fluidizing fluid flow.

19. The Process of claim 17 wherein the article is maintained at the bed temperature by changing to a fluidizing fluid of lower thermal conductivity.

20. The process of claim 1 wherein the article is comprised of aluminum or an aluminum alloy and the initial temperature is an elevated temperature sufficient to allow hardening by quenching, and the article is quenched in the bed with bed variables selected to provide a cooling rate which will increase the hardness of the article material.

21. An apparatus for thermally treating an article, said apparatus comprising:

a bed with about 21 to 60 weight percent of particles having particle size within the range of from about 20 to about 100 microns and about 40 to 79 weight percent of particles having a particle size within the range of from about 150 to about 2000 microns;

a vessel supporting and laterally confining the bed; and means for fluidizing the particles adjacent to the article.

22. The apparatus of claim 21 wherein the particles have a density within the range of from 0.3 to 20 grams per cubic centimeter.

23. The apparatus of claim 21 wherein the particles are alumina.

24. The apparatus of claim 21 wherein the means for fluidizing the particles is a means for passing a fluid upwards through the particles.

25. The apparatus of claim 21 wherein the bed has from about 10 to 50 weight percent of particles having a particle size within the range from about 30 to about 70 microns and about 50 to 90 weight percent of particles having a particle size within the range of from about 150 to about 400 microns.

* * * * *

UNITED STATES PATENT AND TRADEMARK OFFICE

CERTIFICATE OF CORRECTION

PATENT NO. : 5,064,479

DATED : November 12, 1991

INVENTOR(S) : J.S. Van den Sype

It is certified that error appears in the above-identified patent and that said Letters Patent is hereby corrected as shown below:

Column 10, line 2, delete "10" and substitute therefor -- 21 --.

Column 10, line 4, delete "90" and substitute therefor -- 79 --.

Column 12, line 14, delete "10" and substitute therefor -- 21 --.

Column 12, line 16, delete "90" and substitute therefor --79 --.

Signed and Sealed this

Second Day of March, 1993

*Attest:*

STEPHEN G. KUNIN

*Attesting Officer*

*Acting Commissioner of Patents and Trademarks*